US006408628B1

(12) United States Patent
Pidcock et al.

(10) Patent No.: US 6,408,628 B1
(45) Date of Patent: Jun. 25, 2002

(54) WALL ELEMENTS FOR GAS TURBINE ENGINE COMBUSTORS

(75) Inventors: Anthony Pidcock, Chellaston; Desmond Close; Michael P. Spooner, both of Derby, all of (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/703,666

(22) Filed: Nov. 2, 2000

(30) Foreign Application Priority Data

Nov. 6, 1999 (GB) ..... 9926257

(51) Int. Cl.[7] ..... F02C 1/00; F02G 3/00
(52) U.S. Cl. ..... 60/752; 60/755; 60/757
(58) Field of Search ..... 60/752, 755, 757, 60/758

(56) References Cited

U.S. PATENT DOCUMENTS

| | | | | |
|---|---|---|---|---|
| 2,919,549 A | * | 1/1960 | Haworth et al. | 60/39.65 |
| 3,706,203 A | * | 12/1972 | Goldberg et al. | 60/39.65 |
| 4,071,194 A | | 1/1978 | Eckert | |
| 4,184,326 A | * | 1/1980 | Pane, Jr. et al. | 60/39.32 |
| 4,622,821 A | * | 11/1986 | Madden | 60/757 |
| 4,628,694 A | | 12/1986 | Kelm | |
| 4,642,993 A | * | 2/1987 | Sweet | 60/752 |
| 4,695,247 A | * | 9/1987 | Enzaki et al. | 431/352 |
| 4,749,029 A | | 6/1988 | Becker | |
| 4,790,140 A | | 12/1988 | Sato | |
| 4,901,522 A | * | 2/1990 | Commaret et al. | 60/39.32 |
| 5,113,660 A | * | 5/1992 | Able et al. | 60/752 |
| 5,553,455 A | * | 9/1996 | Craig et al. | 60/753 |
| 5,624,256 A | * | 4/1997 | Pfeiffer et al. | 432/252 |
| 5,799,491 A | | 9/1998 | Bell | |
| 6,170,266 B1 | * | 1/2001 | Piscock et al. | 60/755 |

FOREIGN PATENT DOCUMENTS

| | | | |
|---|---|---|---|
| EP | 0706009 A2 | * | 4/1995 |
| EP | 0 741 268 A | | 11/1996 |
| GB | 2 087 065 A | | 5/1982 |
| GB | 2 089 483 A | | 6/1982 |
| GB | 2087065 A | * | 5/1985 |
| GB | 2298266 A | * | 8/1996 |

* cited by examiner

*Primary Examiner*—Charles C. Freay
*Assistant Examiner*—Han Lieh Liu
(74) *Attorney, Agent, or Firm*—W. Warren Taltavull; Manelli, Denison & Selter PLLC

(57) ABSTRACT

A wall element (29A, 29B) for a combustor (20) of a gas turbine engine (10). The wall element (29A, 29B) defines an axis. In use, the axis is arranged generally parallel to the principal axis of the engine (10). In one aspect, the length of the wall element (29B) along the axis is at least substantially 20% of the length of the wall element (29B) transverse to the axis. In another aspect, the wall element (29A, 29B) has a first pair of opposite edges extending transverse to the axis and a second pair of opposite edges (48, 50) extending transverse to the first pair, at least one of the second pair of edges (48, 50) being angled relative to the axis of the wall element (29A, 29B).

31 Claims, 6 Drawing Sheets

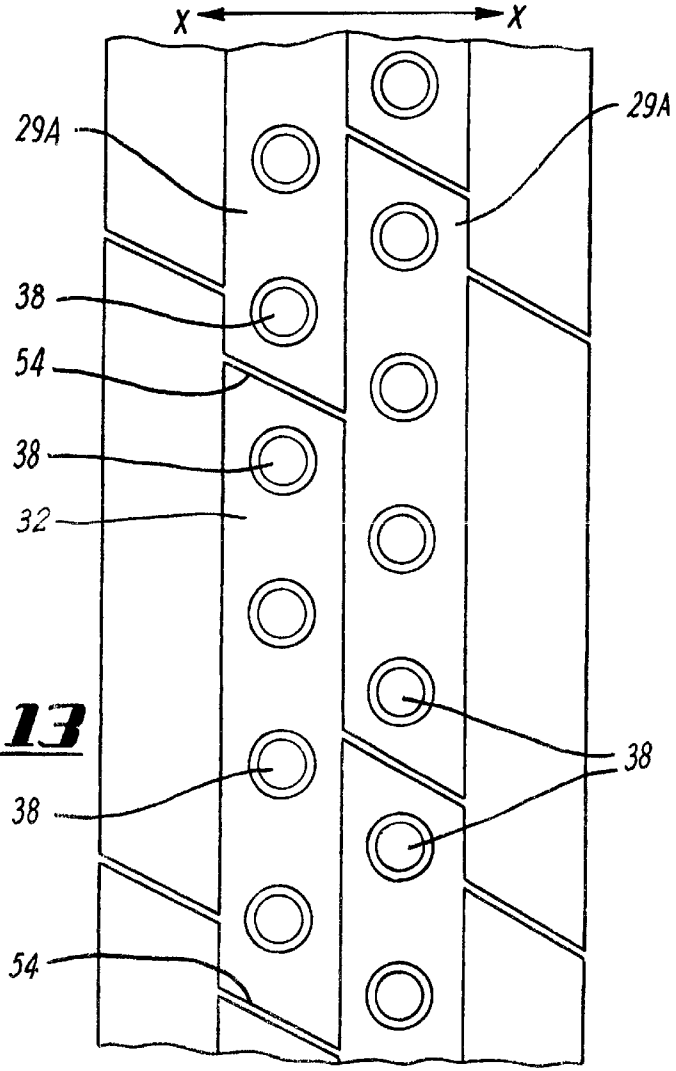
FIG. 13
FIG. 12
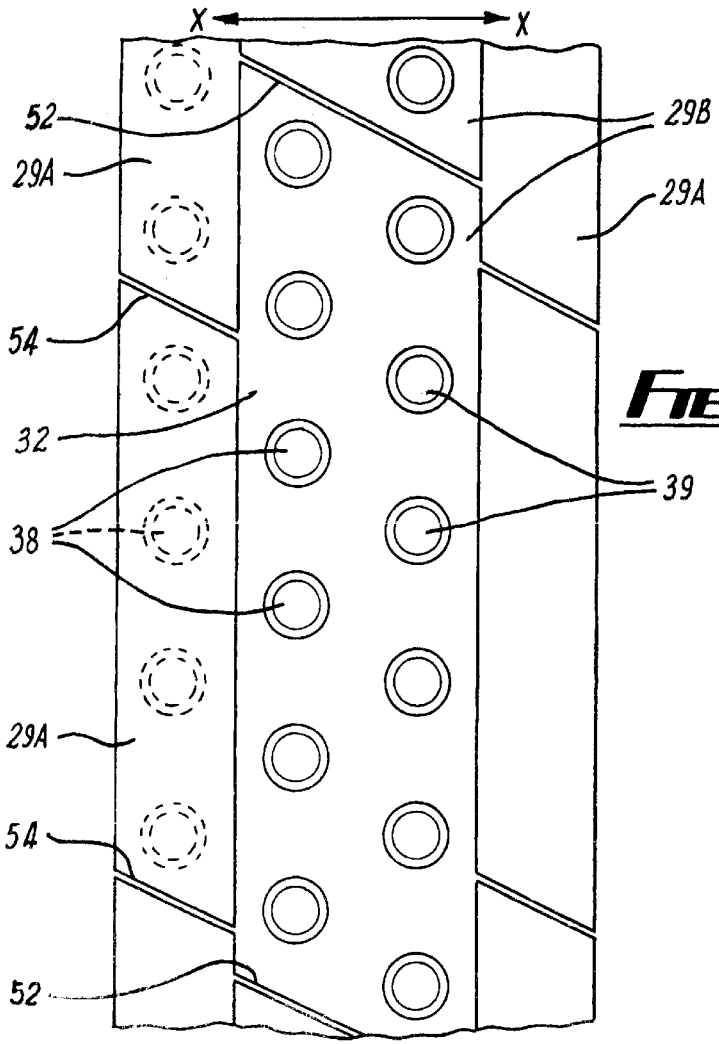

WALL ELEMENTS FOR GAS TURBINE ENGINE COMBUSTORS

FIELD OF THE INVENTION

This invention relates to combustors for gas turbine engines and in particular to wall elements for use in wall structures of combustors of gas turbine engines.

It is known to construct combustors of gas turbine engines with an outer wall and an inner wall, the inner wall being formed of a plurality of tiles. Cooling air is used to prevent overheating of the combustor walls, but air pollution regulations require a high proportion of air to be used for combustion so that the air available for cooling is reduced. Known tiles give rise to problems because of the conflicting requirements of cooling and emission reduction.

SUMMARY OF THE INVENTION

According to one aspect of this invention, there is provided a wall element for a wall structure of a gas turbine engine combustor, the wall element comprising a base portion having an axis which, in use extends generally parallel to the principal axis of the engine, wherein the dimension of said base portion parallel to said axis thereof is greater than substantially 20% of the dimension of the base portion transverse to said axis, and the base portion includes a plurality of rows of mixing ports to allow gas to enter the combustor in use.

The dimension of said base portion parallel to said axis thereof may be greater than substantially 40% of its length transverse to said axis. In one embodiment, the dimension of the base portion parallel to said axis is substantially equal to its dimension transverse to said axis thereof.

Desirably, the dimension of the wall element parallel to said axis thereof is greater than substantially 40 mm. Said dimension may be between substantially 40 mm and substantially 80 mm, but, preferably, the dimension of the wall element parallel to said axis thereof is greater than substantially 80 mm. In one embodiment, the dimension of the wall element parallel to said axis thereof is substantially 250 mm and may be the same as said dimension of the wall element transverse to said axis thereof.

In one embodiment, the wall element has two of said rows. Preferably, each row extends substantially transverse to said axis of the wall element.

The base portion may define a plurality of apertures for the passage of a cooling fluid to cool a surface of the wall element which, in use, faces, inwardly of the combustor. Preferably the apertures are in the form of effusion holes and may be arranged to direct a film of cooling air along said surface of the base portion.

The apertures may be defined at or adjacent the edge regions of the base portion. The base portion may be provided with upstream and downstream edge regions, the apertures preferably being located adjacent the downstream edge region.

Alternatively, or in addition, the apertures may be spaced from the edge regions, and are preferably spaced along a line extending substantially transverse to said axis of the wall structure. Conveniently, said line of apertures extends substantially centrally of the base portion. Preferably, the apertures are angled to direct the cooling fluid towards the downstream edge of the base portion.

At least the downstream edge of the base portion may be provided with an outwardly directed flange which, in use, engages an outer wall of the combustor. The outwardly directed flange may include a lip portion adapted to engage an adjacent downstream wall element. An outwardly directed flange may be provided on the upstream edge of the base portion.

Alternatively, downstream edge of the base portion may be open to allow cooling fluid to flow over said downstream edge. The upstream edge may be open to allow cooling fluid to flow over the upstream edge.

The wall element may be stepped to correspond with a step on the outer wall of the combustor.

In one embodiment, the wall element includes a barrier member extending at least part way across the base portion, the barrier member being provided to control the flow of cooling fluid across said base portion.

Preferably, the barrier member is provided on the wall element such that cooling fluid passing over the base portion on one side of the barrier member is directed away from the barrier member on said one side.

In one embodiment, the barrier member may be provided such that cooling fluid passing over the base portion on first and second opposite sides of the barrier member is directed in first and second opposite directions away from said barrier member.

Preferably, the barrier member acts such that cooling fluid passing over the base portion on one side thereof is prevented from passing over the barrier member to the other side. Preferably, the first and second sides of the barrier member are isolated from each other.

Preferably, the barrier member extends transverse to said axis of the wall structure. The barrier member preferably extends substantially perpendicular to said axis of the wall structure. In another embodiment, the barrier member extends substantially parallel to said axis of the wall structure.

The barrier member may extend substantially wholly across the base portion.

The wall element may be provided with a plurality of barrier members which may define a boundary of a region for the flow of a cooling fluid, wherein said region is isolated from the remainder of the wall element, thereby resulting in increased or decreased pressure of said cooling fluid in said region relative to the remainder of said wall element.

The plurality of barrier members may each be axially extending barrier members or may each be transversely extending barrier members.

Preferably, said plurality of barrier members comprise at least one axially extending barrier member and at least one transversely extending barrier member. Each of the plurality of barrier members may engage or abut each adjacent barrier member to define said region.

The, or each, barrier member may be in the form of an elongate bar which may extend substantially from said base portion to said outer wall.

The inner wall may comprise a plurality of said wall elements.

According to another aspect of this invention, there is provided a wall element for a combustor of a gas turbine engine, the wall element comprising a base portion having an axis which, in use, extends generally parallel to the principal axis of the engine, and the base portion having a first pair of opposite edges extending transverse to said axis of the wall element and a second pair of opposite edges extending transverse to said first pair wherein at least one of said second pair of edges is angled relative to said axis of the base portion to extend obliquely to said axis.

Preferably, both of the edges of said second pair are angled relative to the axis of the base portion. Conveniently, both edges of said second pair extend substantially parallel to each other.

The or each edge of said second pair may be angled relative to the axis of the base portion at an angle of between substantially 10° and substantially 40°, preferably substantially 20° and substantially 30°. More preferably, the angle is substantially 30°.

In one embodiment, the wall element comprises the features of the wall element described in paragraphs three to twenty three above.

According to another aspect of this invention, there is provided a combustor wall structure of a gas turbine engine, the wall structure comprising inner and outer walls, the inner wall including at least one wall element as described above.

Embodiments of the invention will now be described by way of example only, with reference to the accompanying diagrammatic drawings, in which:

DESCRIPTION OF THE DRAWINGS

FIG. 12 is a top plan view of a wall element; and

FIG. 13 is a top plan view of a further embodiment of a wall element.

DETAILED DESCRIPTION

Figure 1:
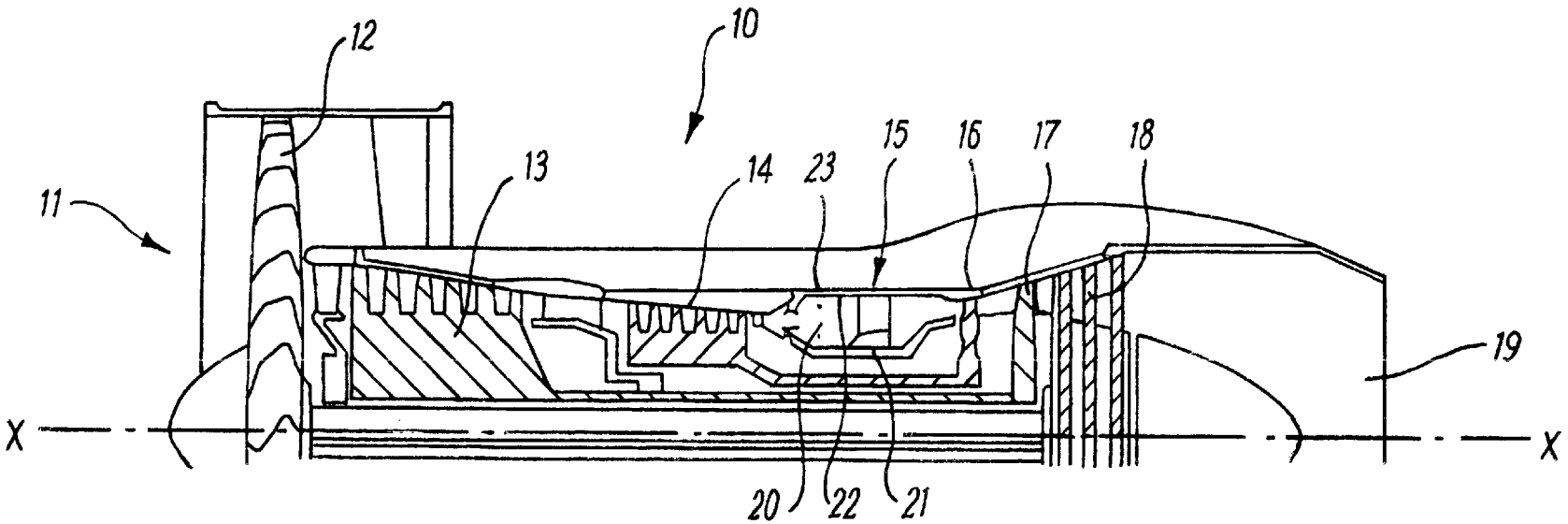
FIG. 1 is a sectional side view of a gas turbine engine.

With reference to FIG. 1, a ducted fan gas turbine engine generally indicated at 10 has a principal axis X-X. The engine 10 comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in the conventional manner so that air entering the intake 11 is accelerated by the fan to produce two air flows: a first air flow into the intermediate pressure compressor 13 and a second air flow which provides propulsive thrust. The intermediate pressure compressor 13 compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbine 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts.

Figure 2:
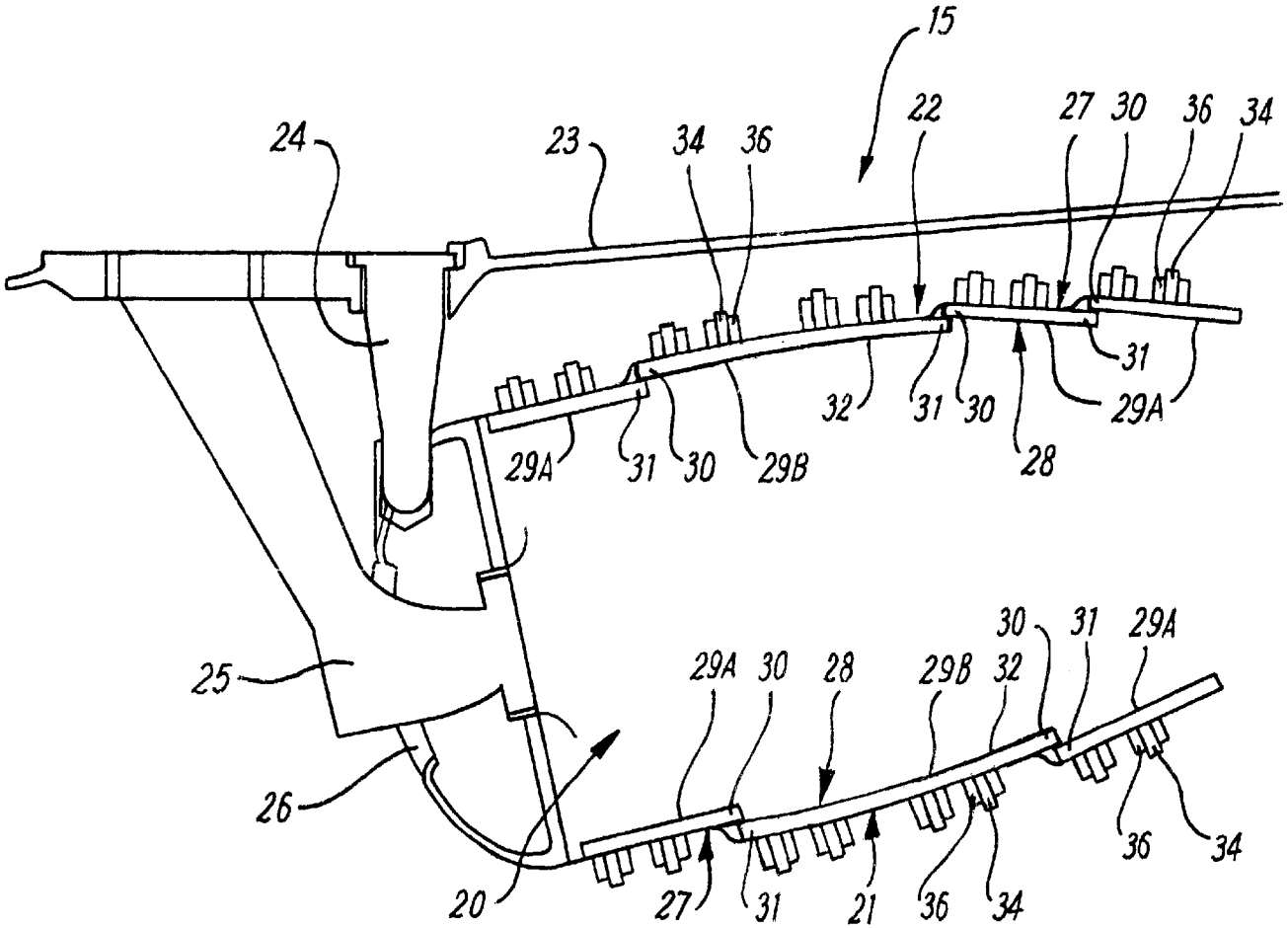
FIG. 2 is a sectional side view of part of a combustor of the engine shown in FIG. 1.

Referring to FIG. 2, the combustor 15 is constituted by an annular combustion chamber 20 having radially inner and outer wall structures 21 and 22 respectively. The combustor 15 is secured to a wall 23 by a plurality of pins 24 (only one of which is shown). Fuel is directed into the chamber 20 through a number of fuel nozzles 25 located at the upstream end 26 of the chamber 20. The fuel nozzles are circumferentially spaced around the engine 10 and serve to spray fuel into air derived from the high pressure compressor 14. The resultant fuel/air mixture is then combusted within the chamber 20.

The combustion process which takes place within the chamber 20 naturally generates a large amount of heat. It is necessary, therefore, to arrange that the inner and outer wall structures 21 and 22 are capable of withstanding the heat.

The radially inner and outer wall structures 21 and 22 each comprise an outer wall 27 and an inner wall 28. The inner wall 28 is made up of a plurality of discrete wall elements in the form of tiles 29A and 29B. The tiles 29A have an axis Y-Y (see FIGS. 3 and 6) which extends generally parallel to the principal axis X-X of the engine 10. The tiles 29A have a dimension of nominally 40 mm parallel to the axis Y-Y. The tiles 29B have a principal axis Z-Z (see FIGS. 3, 5, 7 and 8) which extends generally parallel to the principal axis X-X of the engine 10. The dimension of the tiles 29B parallel to the axis Z-Z is longer than the corresponding dimensions of the tiles 29A. The length of this dimension is typically greater than 20% of the length of the dimension perpendicular to the axis Z-Z. For example, in the embodiments shown, the dimension of the tile 29B parallel to the axis Z-Z is substantially 80 mm. However, it will be appreciated that the axial length of the tiles 29B could be longer than 40% of the dimension perpendicular to the axis Z-Z. For example the dimension of the tiles 29B parallel to the axis Z-Z could equal the dimension of the tile in the circumferential direction i.e. substantially perpendicular to the axis Z-Z. In such a case, the dimension of the tiles 29B parallel to the axis Z-Z may be substantially 250 mm.

Each of the tiles 29A, 29B has circumferentially extending edges 30 and 31, and the tiles are positioned adjacent each other, such that and the edges 30 and 31 of adjacent tiles 29A, 29B overlap each other. Alternatively, the edges 30, 31 of adjacent tiles can abut each other. Each tile 29A, 29B comprises a base portion 32 which is spaced from the outer wall 27 to define therebetween a space 44 for the flow of cooling fluid in the form of cooling air as will be explained below. Heat removal features in the form of pedestals 45 are provided on the base portion 32 and extend into the space 44 towards the outer wall 27.

Securing means in the form of a plurality of threaded plugs 34 extend from the base portions 32 of the tiles 29A, 29B through apertures in the outer wall 27. Nuts 36 are screwed onto the plugs 34 to secure the tiles 29A, 29B to the outer wall 27.

Referring to FIGS. 3 to 6, during engine operation, some of the air exhausted from the high pressure compressor is permitted to flow over the exterior surfaces of the chamber 20. The air provides chamber 20 with cooling and some of the air is directed into the interior of the chamber 20 to assist in the combustion process. First and second rows of mixing ports 38, 39 are provided in the longer tiles 29B and are axially spaced from each other. The ports 38 correspond to apertures 40 in the outer wall 27, and the ports 39 correspond to apertures 41 in the outer wall 27.

The provision of longer tiles 29B has the advantage that it allows the position of the rows of mixing ports to be moved closer together compared with the case if all the tiles were in the form of the shorter tiles 29A.

In addition, holes 42 (only some of which are shown) are provided in the outer wall 27 to allow a cooling fluid in the form of cooling air to enter the space 44 defined between the outer wall 27 and the base portion 32 of the tiles 29A, 29B.

The cooling air passes through the holes 42 and impinges upon the radially outer surfaces of the base portions 32. The air then flows through the space 44 in upstream and downstream directions, and is exhausted from the space 44 between the tiles 29A, 29B and the outer wall 27 in one or more of a plurality of ways shown in FIGS. 3 to 6, as described below.

Figure 3:
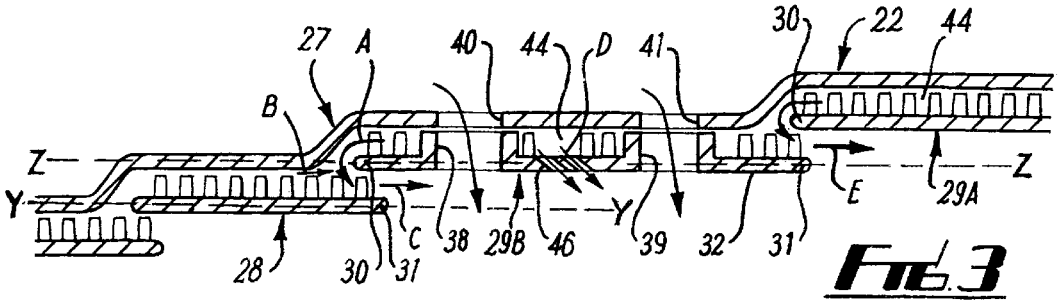
FIG. 3 is a sectional side view of part of a wall structure of a combustor showing a wall element.

Referring particularly to the longer tiles 29B, arrow A in FIG. 3 indicates air exiting via the open upstream edge 30 of the tile 29B and mixing with downstream air flowing from the upstream adjacent tile 29A, as indicated by arrow B. The arrow C indicates the resultant flow of air. Angled effusion holes 46 are provided centrally of the tile 29B between the ports 38 and 39. Arrow D indicates a flow of air exiting from the space 44 through the holes 46. Also, a flow of downstream air exits from the open downstream edge 31 of the tile 29B after mixing with upstream air flowing from the adjacent tile 29A, as indicated by arrow E.

Figure 4:
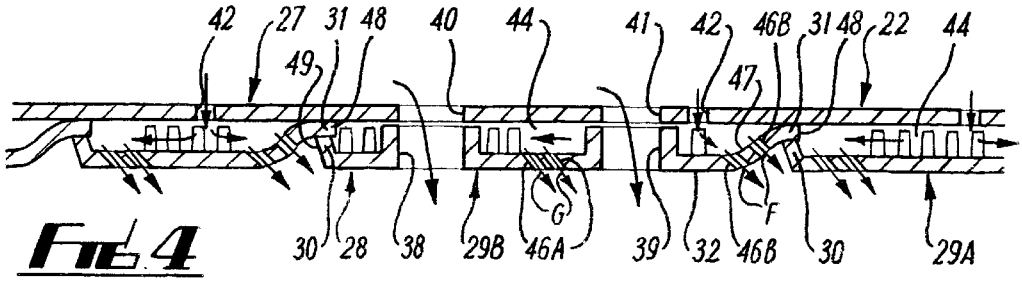
FIGS. 4, 5, and 6 are sectional side views similar to FIG. 1 showing different embodiments of the wall elements.

Referring particularly to the longer tile 29B in FIG. 4, air exits via centrally arranged effusion holes 46A as indicated by the arrow G. In addition, air exits via effusion holes 46B defined in the downstream edge 31 of the tile 29B, as shown by the arrow F. The downstream edge 31 is provided with an outwardly directed circumferentially extending flange 47 which engages the outer wall 27. The flange 47 includes a circumferentially extending lip portion 48 to engage the adjacent downstream tile 29A. The upstream edge 30 is provided with a lip 49 which engages the adjacent upstream tile 29A at its lip portion 48.

Figure 5:
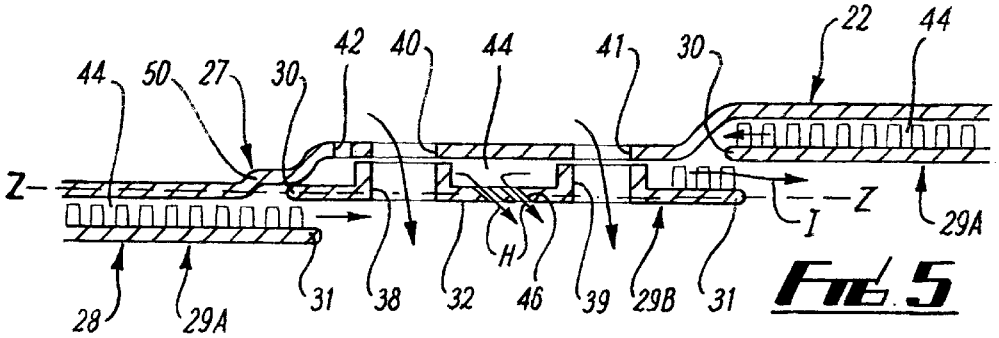

In FIG. 5, the upstream edge 30 of the tile 29B engages a shoulder 50 of the outer wall 27, thereby preventing the exit of air at the edge 30. Thus, air exits via the open downstream edge 31 of the tile 29B after mixing with cooling air from the adjacent downstream tile 29A indicated by the arrow I. Air also exits via centrally arranged effusion holes 46, as indicated by arrow H.

Figure 6:
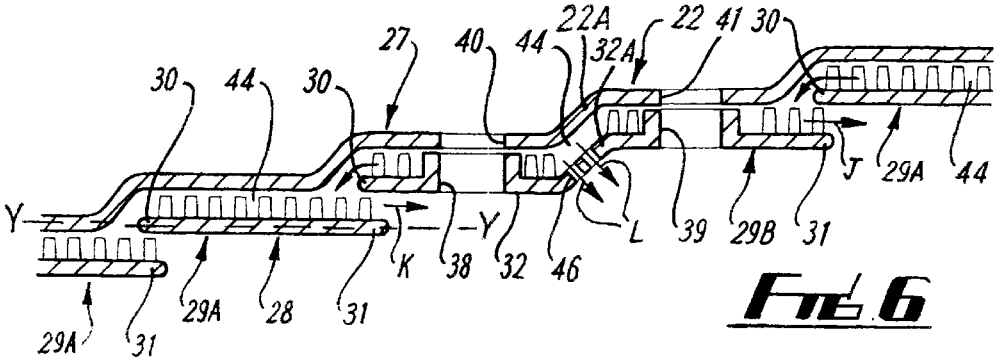

In FIG. 6, arrow J shows air exiting via the downstream edge 31 of the tile 29B after mixing with air from the downstream tile 29A, arrow K shows air exiting via the upstream edge 30 of the longer tile 29B after mixing with air from the upstream tile 29A and arrow L shows air exiting by centrally arranged effusion holes 46. The tile 29A shown in FIG. 6 is of a stepped configuration comprising a step 32A in the base portion 32 corresponding with a step 22A in the outer wall 22. Thus, the tile 29A conforms to the shape of the outer wall 22.

Referring to FIGS. 7 to 11, there are shown different embodiments of tiles 29B.

In each case, the outer wall 27 is provided with a plurality of effusion holes 140 to permit the ingress of air into the space 44 between the base portion 32 of the tile 29 and the outer wall 27. The arrows A in FIGS. 7 and 8 indicate the direction of air flow across the tiles from the effusion holes 140.

Each of the tiles 29B is provided with at least one barrier member 144 in the form of an elongate bar extending across the base portion 32.

Figure 7:
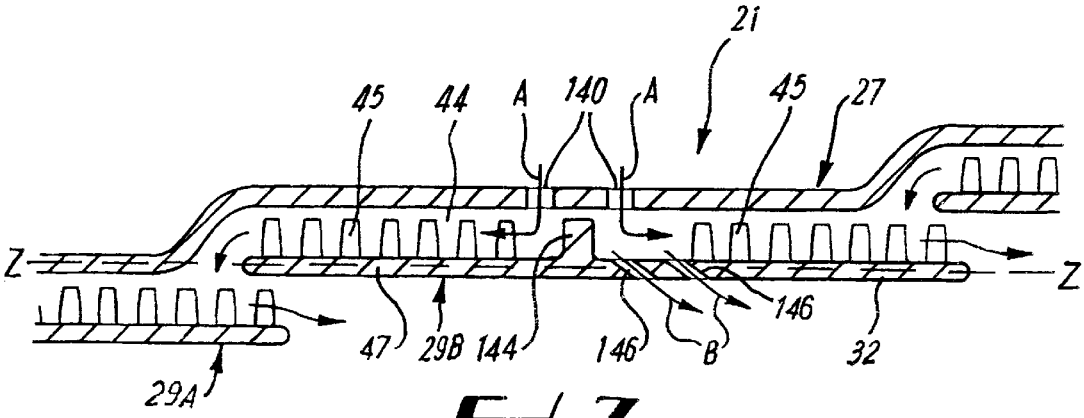
FIG. 7 is a sectional side view of a further embodiment of a wall structure showing a wall element.
Figure 9:
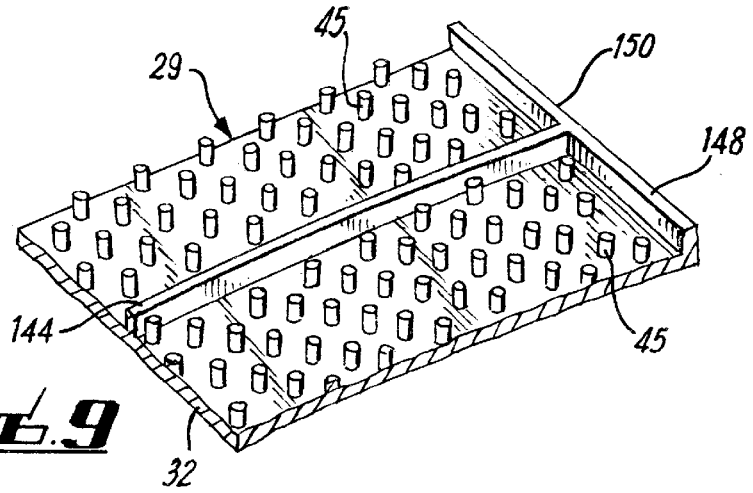
FIG. 9 is a perspective view of part of the wall element shown in FIG. 7.

FIG. 7 shows a cross-section of the wall structure 21 parallel to the principal axis of the engine 10. Reference is also made to FIG. 9 which shows the tile 29 of FIG. 3. The tile 29 shown in FIGS. 3 and 5 has a circumferentially extending barrier member 144. The barrier member 144 extends wholly across the base portion 32. As seen in FIG. 7, the barrier member 44 extends from the base portion 32 substantially to the outer wall 27.

As shown in FIG. 7, the effusion holes 140 are provided in the outer wall 27 on either side of the barrier member 144. Thus cooling air entering the space 44 via the effusion holes 140 is directed by the barrier member 144 in opposite directions away from the barrier member as shown by the arrows A. The cooling air in the space 44 then follows upstream and downstream paths across the tile 29 to exit therefrom at opposite circumferentially extending edges.

If desired, the tile 29 may be provided centrally with effusion holes 146 to direct air into the combustor 20, as shown by the arrows B, to supplement the air film cooling the surface 47 of the base portion 32 of the tile 29.

Referring to FIG. 9 a lip 148 extends along one of the axially extending edges 150 of the tile 29. A similar lip is also provided at the opposite axially extending edge but for reasons of clarity, only one axial edge 150 is shown, and hence, only one lip 148.

Figure 8:
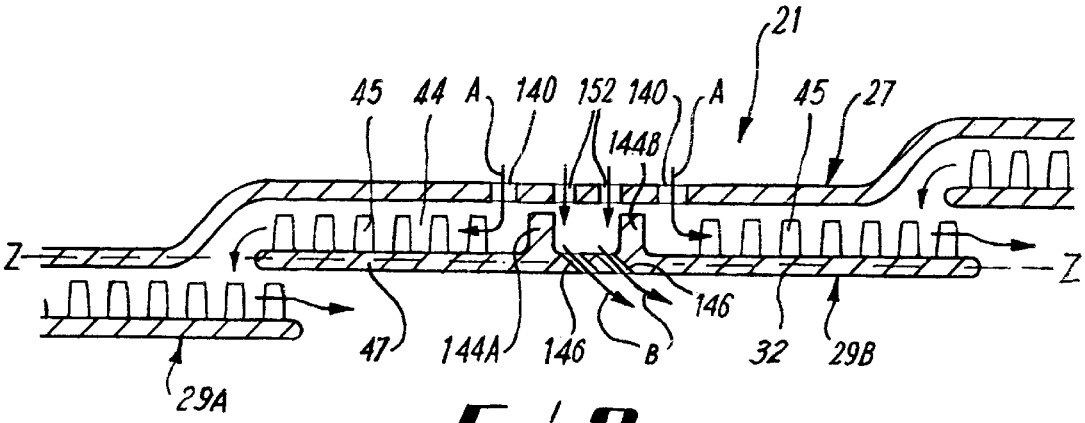
FIG. 8 is a sectional side view of another embodiment of a wall structure showing a further wall element.

FIG. 8 shows a variation of the tile as shown in FIG. 7, in which two circumferentially extending barrier members 144A, 144B are provided. With the embodiment shown in FIG. 8, the outer wall 27 is provided with effusion holes 140 on opposite sides of the barrier members 144A, 144B, whereby cooling air is directed in the upstream and downstream directions, in a similar manner to that shown in FIG. 7.

The outer wall 27 is also provided with further effusion holes 152 arranged to direct cooling air into the region defined between the barrier members 144A, 144B. The cooling air travelling into the region between the barrier members 144A, 144B is directed through effusion holes 146, as shown by the arrows B, to supplement the cooling air passing across the inner surface 47 of the tile 29. By providing two barrier members 144A and 144B, the pressure drop across the effusion holes 46 is somewhat less than with the embodiment shown in FIG. 3.

Figure 10:
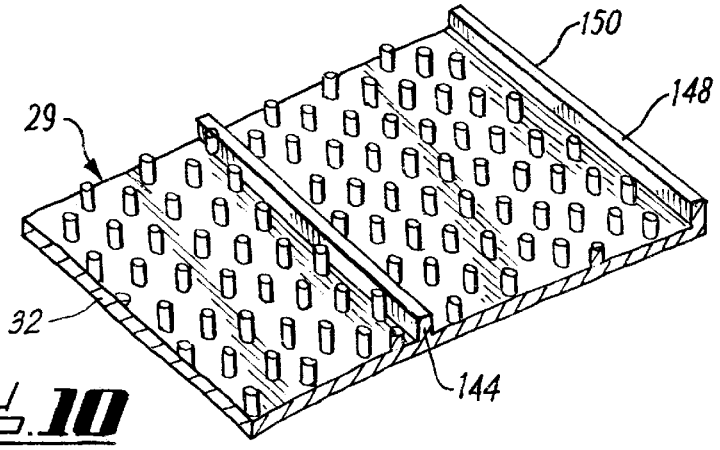
FIG. 10 is a perspective view of part of a further wall element.

Referring to FIG. 10 there is shown a further embodiment of the tile 29 having a barrier member 144 extending in a direction which would be parallel to the principal axis of the engine 10. Thus, cooling air is directed circumferentially across the tile 29.

Figure 11:
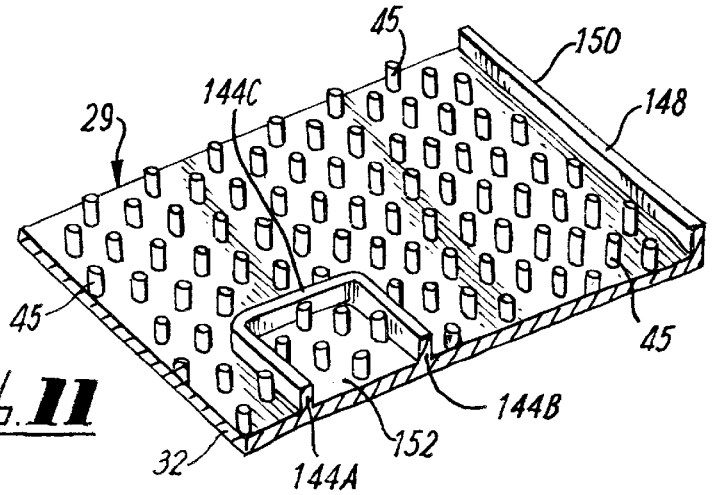
FIG. 11 is a perspective view of part of another wall element.

FIG. 11 shows a further embodiment of the invention comprising first and second axially extending barrier members 144A, 144B and a transversely extending barrier member 144C, the barrier members 144A, 144B and 144C being arranged in engagement with each other to define a region 152 into which cooling air can be concentrated through effusion holes (not shown) in the outer wall 27. The embodiment shown in FIG. 11 is particularly useful in the event that a particular region of the tile 29 suffers significantly from overheating. Further effusion holes (not shown) are provided in the base portion 32 to direct air from the region 150 through the base portion 32 to supplement the cooling film passing across the inner surface of the tile 29. The concentration of the cooling air in the region 152 by the barrier members 144A, 144B and 144C results in the pressure drop across the base portion 36 being less than for the remainder of the tile 29.

The tiles described above, and shown in FIGS. 3 to 11 are provided with axial edges which are substantially parallel to the principal axis X-X of the engine 10.

FIGS. 12 and 13 show further embodiments. FIG. 12 is a top plan of an array comprising a plurality of tiles 29A, 29B forming part of the inner wall 28 of the wall structure 22. Tiles 29A have an axial length of substantially 40 mm, and tiles 29B have an axial length of substantially 80 mm, the axial dimension being parallel to the principal axis X-X of the engine 10 and being indicated for ease of reference by the double headed arrow. The tiles 29B have a base portion 32 which incorporates two rows of mixing ports 38, 39 through which air can pass into the interior of the combustor 20. Only one tile 29B is shown in full for clarity. If desired the shorter tiles 29A may also be provided with a single row of mixing ports 38, as shown in dotted lines in FIG. 12.

As can be seen, the mixing ports 38, 39 in the two rows are off-set relative to each other and the tiles 29B have their opposite axial edges 52 arranged obliquely to the principal axis X-X of the engine 10. The axial edges 52 of the tiles 29B are parallel to each other and angled at substantially 30° to the principal axis X-X of the engine 10. The tiles 29A have axial edges 54 which are parallel to each other and are also arranged transversely of the principal axis, at an angle of substantially 30°.

FIG. 13 shows a further embodiment in which a plurality of tiles 29A form the inner wall 27. The tiles 29A have a base portion 32 having an axial length of substantially 40 mm, and are provided with angled edges 54 similar to the edges 54 shown for the tiles 29A in FIG. 12. Each of the tiles 29A as shown in FIG. 8 comprise a single row of mixing ports 38. The angles of the edges 54 as shown in FIG. 13 is also substantially 30° to the principal axis X-X of the engine 10.

There is thus described in FIGS. 3 to 11 combustor wall tiles which are generally longer in the axial dimension of the combustor than known tiles. The tiles described in FIGS. 3 to 11 have the advantage that they include at least two rows of mixing ports to allow air to enter the combustor for combustion purposes, as distinct from cooling purposes. This has the advantage of decreasing the emission of pollutants, for example NOx emissions. The tiles described above also have the advantage of reducing the numbers of fixings required for covering a combustor wall with tiles, since, by being axially longer, fewer individual tiles are required. This reduces the overall weight and cost of a combustor. In addition, a reduction in the number of tiles will also reduce the costs and complexity of the combustor.

In addition, the use of longer tiles 29B, and the consequent reduction in the number of tiles, reduces the number, and total length, of tile edges. This reduces uncontrolled exchange of cooling air from around the edges of the tiles, thereby improving cooling efficiency.

One advantage of providing tiles with such oblique edges, as shown in FIGS. 12 and 13 above, is that, as well as allowing two rows of mixing ports to be provided on longer tiles 29B, the diagonal edge also reduces the effect of flow leakage at the joints between circumferentially adjacent tiles 29A or 29B. In addition, there is a reduction in the deficit of the cooling film in the region directly downstream of the edges of this adjacent tiles 29A or 29B.

Each of the tiles 29A, 29B described above may be curved along its circumferential dimension, i.e. the dimension perpendicular to the axis Y-Y or Z-Z to correspond to the curvature of the combustor walls 27 of the inner and outer wall structures 21 and 22.

Various modifications can be made without departing from the scope of the invention.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A wall element for a wall structure of a gas turbine engine combustor with the engine having a principal axis, the wall element comprising a base portion having an axis which in use, extends generally parallel to the principal axis of the engine, wherein the dimension of said wall element parallel to said axis thereof is greater then substantially 20% of the dimension of the wall element transverse to said axis of the wall element, and the base portion includes a plurality of rows of mixing ports to allow gas to enter the combustor in use.

2. A wall element according to claim 1 wherein the dimension of the wall element parallel to said axis thereof is greater than substantially 40% of its dimension transverse to said axis of the wall element.

3. A wall element according to claim 1 wherein the dimension of the wall element parallel to said axis thereof is substantially equal to its dimension transverse to said axis of the wall element.

4. A wall element according to claim 1 wherein the dimension of the wall element parallel to said axis thereof is greater than substantially 40 mm.

5. A wall element according to claim 1 wherein the dimension of the wall element parallel to said axis thereof is between substantially 40 mm and substantially 80 mm.

6. A wall element according to claim 1 wherein the dimension of the wall element parallel to said axis thereof is greater than substantially 80 mm.

7. A wall element according to claim 1 wherein the dimension of the wall element parallel to said axis thereof is substantially 250 mm.

8. A wall element according to claim 1 wherein the base portion has two of said rows, each row extending substantially transverse to said axis of the wall element.

9. A wall element according to claim 1 wherein the base portion defines a plurality of apertures for the passage of a cooling fluid to cool a surface of the base portion which, in use, faces, inwardly of the combustor.

10. A wall element according to claim 1 wherein said base portion has edge regions and further including a plurality of apertures at or adjacent the edge regions of the base portion for the passage of the cooling fluid therethrough in use.

11. A wall element according to claim 10, the base portion being provided with upstream and downstream edge regions, wherein said apertures are located adjacent the downstream edge region.

12. A wall element according to claim 11 wherein the apertures are spaced from upstream and downstream edge regions of the base portion, and are spaced along a line extending substantially centrally of the base portion and transverse to said axis.

13. A wall element according to claim 11 wherein said combustor has an outer wall and at least the downstream edge of the base portion is provided with an outwardly directed flange adapted, in use, to engage the outer wall of the combustor, said flange including a lip portion adapted to engage an adjacent downstream wall element, an outwardly directed flange being provided on the upstream edge of the base portion.

14. A wall element according to claim 11 wherein said combustor has an outer wall and the upstream and downstream edges of the base portion are spaced from the outer wall to provide an opening to allow cooling fluid to flow over the respective edges.

15. A wall element according to claim 11 wherein said combustor has an outer wall and the downstream edge of the base portion is open to allow cooling fluid to flow over said downstream edge, and wherein the upstream edge is adapted to engage the outer wall substantially to prevent cooling fluid flow over said upstream edge.

16. A wall element according to claim 9 wherein the apertures are in the form of effusion holes adapted to direct a film of cooling fluid along said surface of the base portion.

17. A wall element according to claim 1 further including a barrier member extending at least part way across the base portion, the barrier member serving to control flow of cooling fluid across said base portion in use.

18. A wall element for a combustor of a gas turbine engine with the engine having a principal axis, the wall element comprising a base portion having an axis which, in use, extends generally parallel to the principal axis of the engine, and the base portion having a first pair of opposite edges extending transverse to said axis of the base portion and a second pair of opposite edges extending transverse to said first pair of edges wherein at least one of said second pair of edges is angled relative to said axis of the base portion to extend obliquely relative to said axis of said base portion, said base portion including at least one row of mixing ports extending between the second pair of edges to allow gas to enter the combustor in use.

19. A wall element according to claim 18 wherein both of the edges of said second pair of edges are angled as aforesaid relative to the axis of the base portion and extend substantially parallel to each other.

20. A wall element according to claim 18 wherein the or each edge of said second pair of edges is angled relative to the axis of the base portion at an angle of between substantially 10° and substantially 40°.

21. A wall element according to claim 20 wherein the or each edge of said second pair of edges is angled relative to the axis of the base portion at an angle of between substantially 20° and substantially 30°.

22. A wall element according to claim 20 wherein the or each edge of said second pair of edges is angled relative to the axis of the base portion at an angle of substantially 30°.

23. A wall structure for a gas turbine engine combustor comprising an inner wall and an outer wall, wherein the inner wall comprises a plurality of all elements as claimed in claim 1.

24. A gas turbine engine combustor having a wall structure as claimed in claim 23.

25. A gas turbine engine incorporating a combustor as claimed in claim 24.

26. A wall element for a wall structure of a gas turbine engine combustor with the engine having a principal axis, the wall element comprising a base portion having an axis which in use, extends generally parallel to the principal axis of the engine, wherein the dimension of said wall element parallel to said axis thereof is greater then substantially 20% of the dimension of the wall element transverse to said axis of the wall element, and the base portion includes a plurality of rows of mixing ports to allow gas to enter the combustor in use, the dimension of the wall element parallel to said axis of said base portion being greater than substantially 40 mm.

27. A wall element for a wall structure of a gas turbine engine combustor with the engine having a principal axis, the wall element comprising a base portion having an axis which in use, extends generally parallel to the principal axis of the engine, wherein the dimension of said wall element parallel to said axis thereof is greater then substantially 20% of the dimension of the wall element transverse to said axis of the wall element, and the base portion includes a plurality of rows of mixing ports to allow gas to enter the combustor in use, the dimension of the wall element parallel to said axis of said base portion being between substantially 40 mm and substantially 80 mm.

28. A wall element for a wall structure of a gas turbine engine combustor with the engine having a principal axis, the wall element comprising a base portion having an axis which in use, extends generally parallel to the principal axis of the engine, wherein the dimension of said wall element parallel to said axis thereof is greater then substantially 20% of the dimension of the wall element transverse to said axis of the wall element, and the base portion includes a plurality of rows of mixing ports to allow gas to enter the combustor in use, the dimension of the wall element parallel to said axis of said base portion being greater than substantially 80 mm.

29. A wall element for a wall structure of a gas turbine engine combustor with the engine having a principal axis, the wall element comprising a base portion having an axis which in use, extends generally parallel to the principal axis of the engine, wherein the dimension of said wall element parallel to said axis thereof is greater then substantially 20% of the dimension of the wall element transverse to said axis of the wall element, and the base portion includes a plurality of rows of mixing ports to allow gas to enter the combustor in use, the dimension of the wall element parallel to said axis of said base portion being substantially 250 mm.

30. A wall element for a wall structure of a gas turbine engine combustor with the engine having a principal axis, the wall element comprising a base portion having an axis which in use, extends generally parallel to the principal axis of the engine, wherein the dimension of said wall element parallel to said axis thereof is greater then substantially 20% of the dimension of the wall element transverse to said axis of the wall element, and the base portion includes a plurality of rows of mixing ports to allow gas to enter the combustor in use, said wall element further including a plurality of barrier members extending at least part way across the base portion, the barrier members serving to control flow of cooling fluid across said base portion in use, said barrier members defining a boundary of regions for flow of the cooling fluid isolated from the remainder of the wall element for producing an increase or decrease in pressure of said cooling fluid in said regions relative to the remainder of said wall element.

31. A wall element according to claim 18 wherein a plurality of rows of mixing ports extend between the second pair of edges.

* * * * *